US005983573A

United States Patent [19]

MacKarvich

[11] Patent Number: 5,983,573

[45] Date of Patent: Nov. 16, 1999

[54] TIE-DOWN STRAP FRAME CONNECTOR

[76] Inventor: Charles J. MacKarvich, 1720 Tyler Green Trail, Smyrna, Ga. 30080

[21] Appl. No.: 09/195,468

[22] Filed: Nov. 18, 1998

[51] Int. Cl.[6] ..... E04B 7/18

[52] U.S. Cl. ..... 52/23; 52/293.3; 24/192; 24/199; 24/311; 24/317; 248/499; 248/500; 248/680

[58] Field of Search ..... 52/23, 293.3, 150; 248/499, 500, 680, 681; 24/163 R, 191, 192, 199, 311, 317, 318

[56] References Cited

U.S. PATENT DOCUMENTS

| | | | |
|---|---|---|---|
| 4,003,169 | 1/1977 | Young, II | 52/155 |
| 4,257,570 | 3/1981 | Rasmussen | 248/503 |
| 5,881,499 | 3/1999 | Luzzi | 52/23 |

*Primary Examiner*—Christopher T. Kent
*Assistant Examiner*—Yvonne Horton-Richardson
*Attorney, Agent, or Firm*—Thomas, Kayden, Horstemeyer & Risley

[57] ABSTRACT

A tie-down strap frame connector (10) for use in a stabilizing foundation system (12) for a manufactured home (14) which comprises a frame including at least one flanged support beam (16). The tie-down strap frame connector comprises a hook portion (40) adapted to latch about a flange (58) of the manufactured home support beam, a strap slot (52) adapted to receive a tie-down strap (26) of the stabilizing foundation system, and means for altering the orientation of the strap slot relative to the hook portion so that the tie-down strap can be arranged in non-perpendicular orientations with respect to the manufactured home without creating a torsional stress concentration within the tie-down strap.

15 Claims, 3 Drawing Sheets

TIE-DOWN STRAP FRAME CONNECTOR

FIELD OF THE INVENTION

The invention relates generally to a frame connector for use in a manufactured home stabilizing foundation system using tie-down straps. More particularly, the invention relates to a frame connector which does not create harmful stress concentrations within the tie down straps when the straps are arranged in non-perpendicular orientations with respect to the manufactured home, and which positively locks to the manufactured home frame.

BACKGROUND OF THE INVENTION

Manufactured homes, such as mobile homes, trailers, prefabricated homes, and the like are manufactured at a central manufacturing site and, upon completion, are moved to a location where they are to be occupied. Because these homes are designed to be easily moved from site to another, they are not built on permanent foundations but, rather, typically are placed on piers such as concrete blocks, pilings, or stabilizing jacks. Normally, the piers directly support the frame of the manufactured home which typically comprises two or more support beams, such as steel I-beams, to which the home is fixedly secured.

If the manufactured home is not anchored securely in position on its piers, the home can be shifted by strong winds or earth tremors which can cause the home to be forced from its foundation. Due to this risk, various types of stabilizing systems have been used to stabilize the manufactured homes on their piers to keep the homes from shifting in response to wind and/or seismic forces. In one particularly effective system, a plurality of tie-down straps are used to tether the manufactured home to the ground. In these systems, the tie-down straps typically extend perpendicularly outwardly from incremental positions along the length of the manufactured home. Usually, the tie-down straps extend downwardly from the support beams of the manufactured home frame to ground anchors that are deeply embedded into the soil. Often, the tie-down straps are securely connected to the beams with frame connectors that latch onto the support beams. Normally, these frame connectors comprise a metal clamp member that includes a hook which securely grips an upper flange of the support beam. The tie-down straps usually are threaded through a strap slot formed in the clamp member. These strap slots normally are configured so as to be parallel to the hook and the longitudinal direction of the manufactured home, such that the tie-down straps can be positioned substantially perpendicularly to the longitudinal axis of the manufactured home.

Although functioning adequately under most circumstances, conventional frame connectors present several drawbacks. Most importantly, these frame connectors do not account for longitudinal shifting of the manufactured home due to wind or seismic forces. When a manufactured home shifts under the influence of such forces, the longitudinal position of the frame connectors, and their strap slots, likewise shift in the longitudinal direction. Because the ground attachment points of the tie-down straps are fixed by the anchors, the tie-down straps cannot similarly shift longitudinally, causing the tie-down straps to become arranged in diagonal orientations with respect to the manufactured home. In that the strap slots of the frame connector cannot reorient themselves to accommodate for the diagonal orientations of the straps, torsional stresses are concentrated on the straps at the point where the straps connect to the frame connectors. Such stress concentrations can similarly occur in situations in which the tie-down straps are improperly installed in a non-perpendicular orientation relative to the manufactured home. If large enough, these stresses can cause failure of one or more of the tie-down straps, placing the home in jeopardy of being forced from its foundation. Even if not causing strap failure, these torsional stresses can remove the stabilizing foundation system from compliance with the standards stipulated by the United States Department of Housing and Urban Development (HUD).

In addition to potentially creating harmful stress concentrations on the tie-down straps, conventional frame connectors do not positively lock to the manufactured home frame to prevent the frame connector from being separated from the frame when the manufactured home is shifted in the longitudinal or lateral direction. Specifically, the hooks of conventional frame connectors can dislodge from the flanges of the support beams, rendering the associated tie-down straps practically useless in securing the manufactured home in place on its foundation.

From the above, it can be appreciated that it would be desirable to have a frame connector which does not create harmful stress concentrations on the tie-down strap when the strap is orientated in a non-perpendicular orientation with respect to the home. It can further be appreciated that it would be desirable to have a frame connector which positively locks to the manufactured home frame to prevent dislodging of the frame connector in response to home shifting.

SUMMARY OF THE INVENTION

Briefly described, the present invention relates to a tie-down strap frame connector for use in a stabilizing foundation system for a manufactured home which comprises a frame including at least one flanged support beam. The tie-down strap frame connector comprises a hook portion adapted to latch about a flange of the manufactured home support beam, a strap slot adapted to receive a tie-down strap of the stabilizing foundation system, and means for altering the orientation of the strap slot relative to the hook portion so that the tie-down strap can be arranged in non-perpendicular orientations with respect to the manufactured home without creating a torsional stress concentration within the tie-down strap.

Typically, the frame connector comprises a clamp member, which includes the hook portion, and a swivel member. The clamp member normally further includes a body portion and a coupling portion having a first coupling opening formed therein. The swivel member typically includes a second coupling opening and a strap slot which is adapted to receive a tie-down strap of the stabilizing foundation system. Usually, a coupling member extends through the coupling openings of the clamp member and the swivel member to pivotally couple the swivel member to the clamp member such that the swivel member is pivotable about the coupling member to permit the orientation of the strap slot to be altered.

The objects, features, and advantages of this invention will become apparent upon reading the following specification, when taken in conjunction with the accompanying drawings. It is intended that all such additional features and advantages be included therein with the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
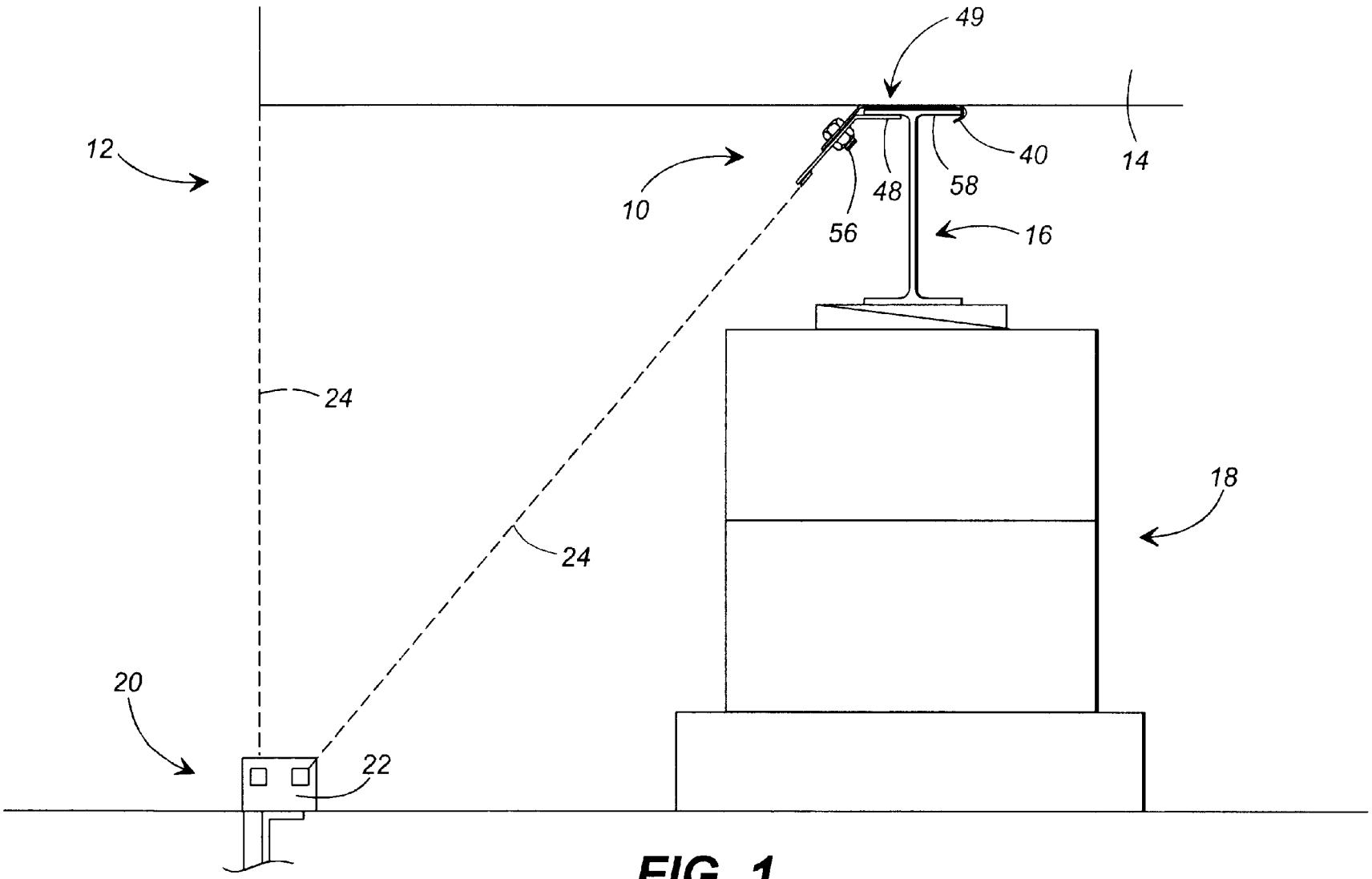
FIG. 1 is a partial end view a manufactured home and manufactured home stabilizing foundation system which includes a frame connector constructed in accordance with the present invention.

Referring now in more detail to the drawings, in which like reference numerals indicate corresponding parts throughout the several views, FIG. 1 illustrates a tie-down strap frame connector 10 as used in a stabilizing foundation system 12 for a manufactured home 14.

As shown in FIG. 1, the manufactured home 14 is supported by a frame comprising at least one support beam 16 and a plurality of support piers 18. Normally, the support beams 16 are formed as steel I-beams and the support piers 18 comprise concrete blocks. The stabilizing foundation system 12 typically comprises a plurality of ground anchors 20, each including a tension head 22 which facilitates attachment of tie-down straps 24 to the anchor. The tie-down straps 24 normally extend upwardly from their respective ground anchors 20 to connect to the manufactured home 14. As indicated in FIG. 1, the tie-down straps 24 can extend about the outer periphery of the manufactured home 14 or, alternatively, connect to the support beams 16 of the manufactured home frame. In the latter case, connection is facilitated by the tie-down strap frame connector 10.

Figure 2:
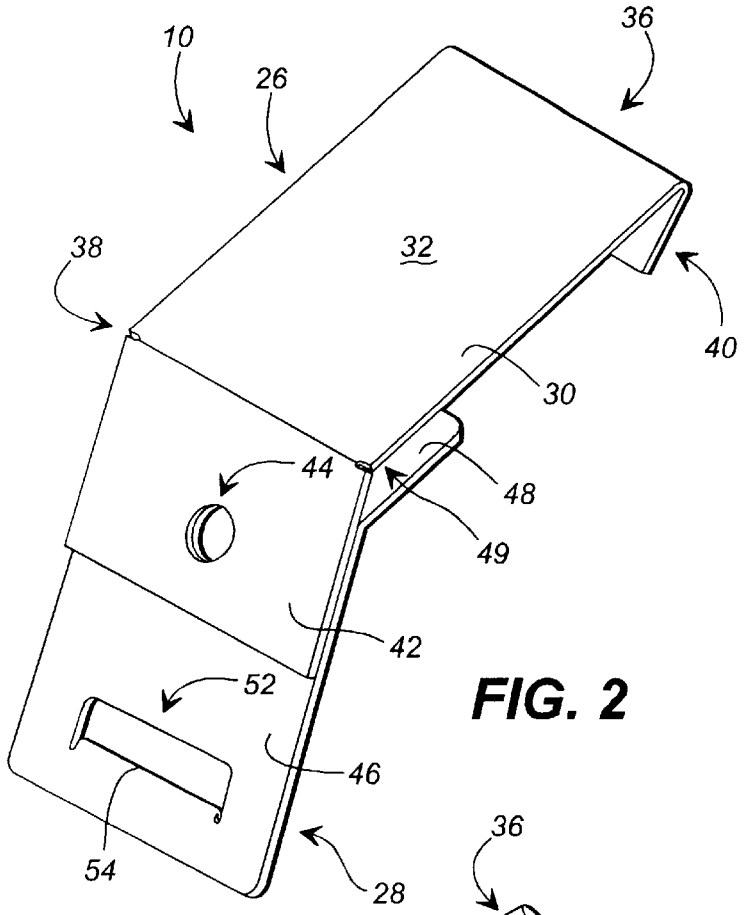
FIG. 2 is a top perspective view of the frame connector shown in FIG. 1.
Figure 3:
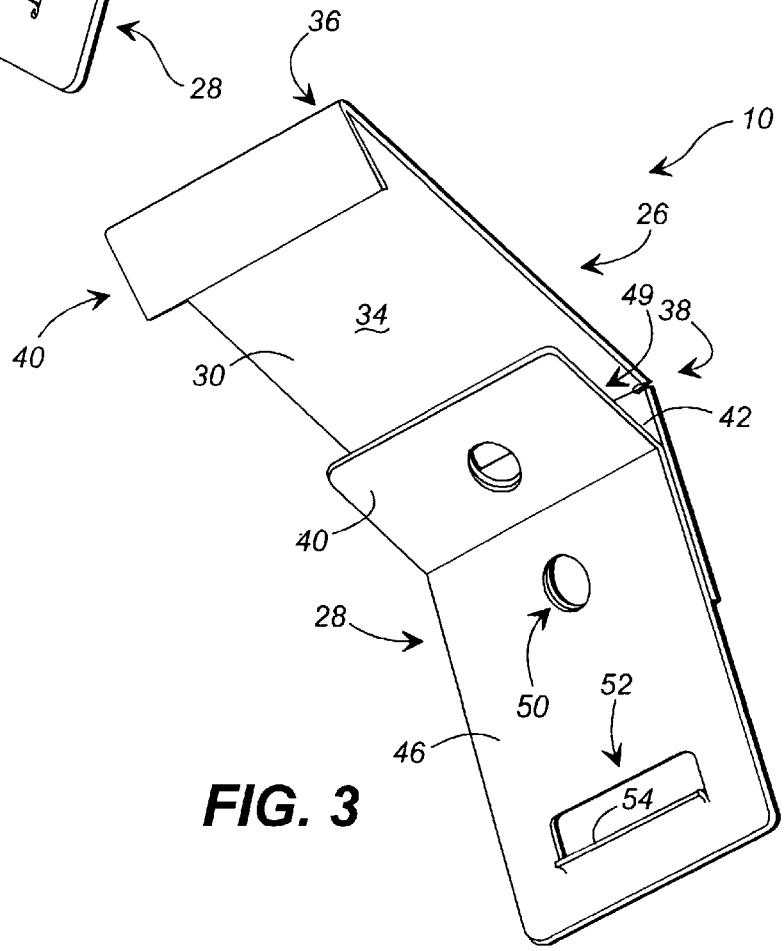
FIG. 3 is a bottom perspective view of the frame connector shown in FIGS. 1–2.

FIGS. 2 and 3 illustrate the tie-down strap frame connector 10 in detail. In particular, these figures depict the frame connector 10 in its typical coupled orientation but with its coupling member (described below) removed for clarity. As shown in these figures, the frame connector 10 generally comprises a clamp member 26 and a swivel member 28. The clamp member 26 includes a substantially planar body portion 30 having top and bottom sides 32 and 34 and front and rear ends 36 and 38. Extending obliquely from the front end 36 of the body portion 30 is a hook portion 40. Extending obliquely from the rear end 38 of the body portion 30 is a coupling portion 42. Like the body portion 30, the hook portion 40 and the coupling portion 42 typically are substantially planar in shape. Normally, the coupling portion 42 is contained in a plane that forms an approximately 45° angle with the plane that contains the body portion 30. The coupling portion 42 includes a coupling opening 44, the purpose for which is described below.

The swivel member 28 comprises a strap connection portion 46 and a lock portion 48. Typically, both the strap connection portion 46 and the lock portion 48 are substantially planar and, similar to the body and coupling portions 30 and 42 of the clamp member 26, are oriented in separate planes so as to be oriented at an angle of approximately 45° with respect to each other. Accordingly, the strap connection and lock portions 46 and 48 are arranged so as to be parallel to the body coupling portions 30 and 42 of the clamp member 28, respectively, when the clamp and swivel members 26 and 28 are coupled in the configuration shown in FIGS. 2 and 3. When coupled in this configuration, the coupling portion 42 of the clamp member 26 and the strap connection portion 46 of the swivel member are in flush abutment with each other, and the body portion 30 of the clamp member 26 and the lock portion 48 of the swivel member 28 define a narrow space 49 therebetween that facilitates locking of the frame connector 10 to a manufactured home support beam.

The strap connection portion 46 of the swivel member 28 includes a coupling opening 50 that is positioned so as to align with the coupling opening 44 of the coupling portion 42 of the clamp member 26. As is explained below, these coupling openings 44, 50 are adapted to receive a coupling member such as a bolt or pin about which the swivel member 28 can pivot relative to the clamp member 26 (see FIGS. 4–6). The strap connection portion 46 further includes a strap slot 52 that is adapted to receive a tie-down strap 24. As indicated most clearly in FIG. 3, the strap slot 52 is provided with a substantially linear, rounded lip 54 which directly receives the tie-down strap to reduce stress imposed on the tie-down strap.

Figure 4:
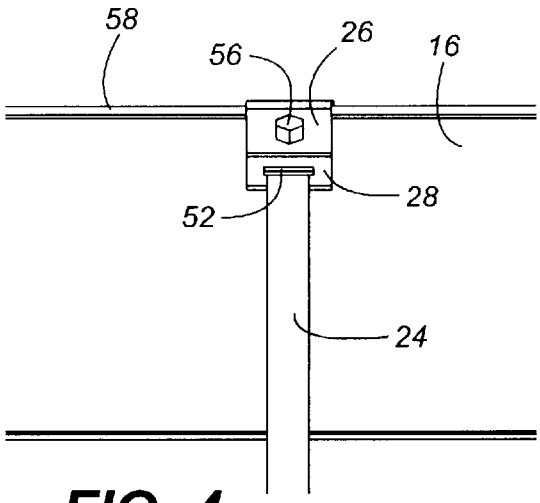
FIG. 4 is a side view of the frame connector of FIGS. 1–3 shown connected to a support beam in a perpendicular orientation.

FIG. 4 depicts the tie-down strap frame connector 10 connected to a manufactured home support beam 16 in a substantially perpendicular orientation. As indicated in this figure, the clamp member 26 and the swivel member 28 are coupled with a coupling member 56 such as a bolt which permits the swivel member to pivot relative to the clamp member about the coupling member. The frame connector 10 extends perpendicularly outwardly from the support beam 16 such that the longitudinal axis of the clamp member 26 and the swivel member 28 are perpendicular to that of the support beam. As illustrated in FIG. 1, the body portion 30 of the clamp member 26 rests atop the support beam 16 with the hook portion 40 of the clamp member latched about a top flange 58 of the support beam to securely connect the frame connector to the beam. As is further indicated in this figure, the lock portion 48 of the swivel member 28 is positioned directly adjacent to the underside of the top flange 58 of the support beam 16 such that the flange is received in the narrow space 49 formed between the clamp member body portion 30 and the swivel member lock portion 48. Connected to the support beam 16 in this manner, the frame connector 10 is locked in place on the beam such that the frame connector will not easily become dislodged from the support beam if and when the manufactured home 14 shifts in either the longitudinal or lateral direction.

Figure 5:
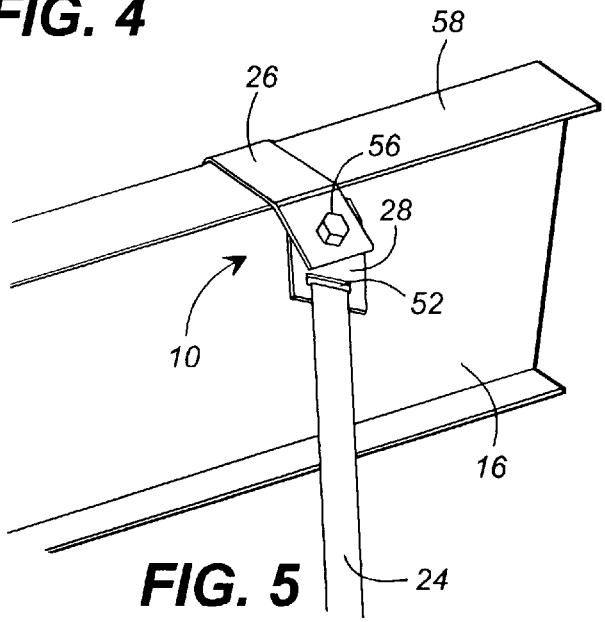
FIG. 5 is an upper perspective view of the frame connector and support beam of FIG. 4 showing the frame connector arranged in a first non-perpendicular orientation.
Figure 6:
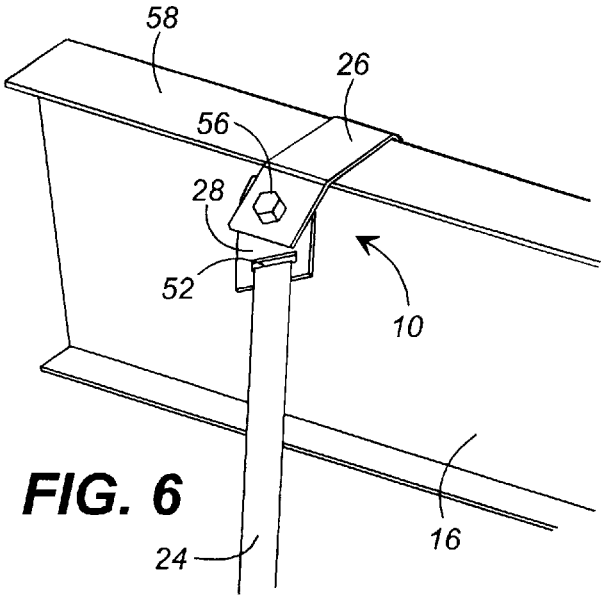
FIG. 6 is an upper perspective view of the frame connector and support beam of FIGS. 4–5 showing the frame connector arranged in a second non-perpendicular orientation.

FIGS. 5 and 6 depict the frame connector 10 and support beam 16 shown in FIG. 4 with the frame connector 10 and its associated tie-down strap 24 oriented in two distinct non-perpendicular orientations. These non-perpendicular orientations of the connector and tie-strap either can be the result of longitudinal shifting of the manufactured home or the result of non-perpendicular positioning of the tie-down straps during installation. In either case, the swivel member 28 is laterally pivoted about the coupling member 56 to accommodate the non-perpendicular orientation of the tie-down strap 24. This pivoting permits the strap slot 52 to arrange in non-parallel orientations relative to the support beam 16 and the hook portion 40 of the clamp member 26 connected thereto so that the tie-down strap 24 can similarly be arranged in non-perpendicular orientations relative to the manufactured home. As can be appreciated from these figures, torsional stress concentrations are not created within the strap 24 in that the strap slot 52 is maintained in a perpendicular orientation relative to the longitudinal axis of the tie-down strap 24, regardless of the strap's orientation relative to the manufactured home. When the frame connector 10 is in such a non-perpendicular orientation, the positive locking of the frame connector to the support beam 16 is maintained due to contact between the swivel member lock portion 48 and the underside of the beam. In particular, the lock portion 48 conforms to the contours of the support beam as the tie-down strap 24 is tensioned in a non-perpendicular direction relative to the longitudinal axis of the manufactured home 14.

While preferred embodiments of the invention have been disclosed in detail in the foregoing description and drawings, it will be understood by those skilled in the art that variations and modifications thereof can be made without departing from the spirit and scope of the invention as set forth in the following claims.

I claim:

1. A tie-down strap frame connector for use in a stabilizing foundation system for a manufactured home which comprises a frame including at least one flanged support beam, said tie-down strap frame connector comprising:

a clamp member including a body portion, a hook portion, and a coupling portion, said hook portion being adapted to latch about a flange of the manufactured home support beam, said coupling portion including a first coupling opening formed therein;

a swivel member including a second coupling opening and a strap slot adapted to receive a tie-down strap of the stabilizing foundation system; and a coupling member that extends through said coupling openings of said clamp member and said swivel member to pivotally couple said swivel member to said clamp member such that said swivel member is pivotable about said coupling member so that said strap slot can be arranged in non-parallel orientations with respect to said hook portion so that the tie-down strap can be arranged in non-perpendicular orientations with respect to the manufactured home without creating a torsional stress concentration within the tie-down strap.

2. The frame connector of claim 1, wherein said swivel member comprises a strap connection portion and a lock portion, said second coupling opening and said strap slot being formed in said strap connection portion of said swivel member.

3. The frame connector of claim 2, wherein said coupling portion of said clamp member and said strap connection portion of said swivel member are substantially planar and in flush abutment with each other.

4. The frame connector of claim 2, wherein said body portion of said clamp member and said lock portion of said swivel member are substantially planar and define a narrow space therebetween that is adapted to receive the support beam flange to lock said frame connector in place when connected to the support beam.

5. The frame connector of claim 1, wherein said strap slot includes a rounded lip that is adapted to directly receive the tie-down strap.

6. The frame connector of claim 1, wherein said hook portion of said clamp member extends obliquely from said body portion of said clamp member.

7. The frame connector of claim 1, wherein said coupling portion of said clamp member extends obliquely from said body portion of said clamp member.

8. The frame connector of claim 1, wherein said coupling member is a bolt.

9. A tie-down strap frame connector for use in a stabilizing foundation system for a manufactured home which comprises a frame including at least one flanged support beam, said tie-down strap frame connector comprising:

a hook portion adapted to latch about a flange of the manufactured home support beam;

a strap slot adapted to receive a tie-down strap of the stabilizing foundation system; and means for altering the orientation of said strap slot so that said strap slot can be arranged in non-parallel orientations with respect to said hook portion so that the tie-down strap can be arranged in non-perpendicular orientations with respect to the manufactured home without creating a torsional stress concentration within the tie-down strap.

10. The frame connector of claim 9, wherein said hook portion is formed on a clamp member of said frame connector.

11. The frame connector of claim 10, wherein said means for altering the orientation of said strap slot comprises a swivel member in which said strap slot is formed, said swivel member being pivotably coupled to said clamp member such that said swivel member is pivotable relative to said clamp member.

12. The frame connector of claim 11, wherein said means for altering the orientation of said strap slot further comprises first and second coupling openings formed in said clamp member and said swivel member, respectively, and a coupling member that extends through said opening.

13. The frame connector of claim 9, further comprising locking means for locking said frame connector in place when connected to a manufactured home support beam.

14. The frame connector of claim 13, wherein said locking means comprises a lock portion of said swivel member that, together with said clamp member, defines a narrow space that is adapted to receive a flange of the support beam to lock the frame connector in place.

15. The frame connector of claim 9, wherein said strap slot includes a rounded lip that is adapted to directly receive the tie-down strap.

* * * * *